US010020598B2

(12) United States Patent
Lappoehn

(10) Patent No.: US 10,020,598 B2
(45) Date of Patent: Jul. 10, 2018

(54) PLUG CONNECTOR HAVING AT LEAST ONE DISPLACEMENT INSULATION CONTACT OFFSET RELATIVE TO A SPRING OR BLADE CONTACT ELEMENT

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/531,476

(22) PCT Filed: Dec. 8, 2015

(86) PCT No.: PCT/DE2015/100523
§ 371 (c)(1),
(2) Date: May 30, 2017

(87) PCT Pub. No.: WO2016/095899
PCT Pub. Date: Jun. 23, 2016

(65) Prior Publication Data

US 2017/0264025 A1 Sep. 14, 2017

(30) Foreign Application Priority Data

Dec. 15, 2014 (DE) ..... 10 2014 118 687

(51) Int. Cl.
*H01R 4/24* (2018.01)
*H01R 4/2433* (2018.01)
(Continued)

(52) U.S. Cl.
CPC ..... *H01R 4/2433* (2013.01); *H01R 13/112* (2013.01); *H01R 13/506* (2013.01); *H01R 13/582* (2013.01); *H01R 2107/00* (2013.01)

(58) Field of Classification Search
CPC ... H01R 4/2408; H01R 4/2433; H01R 4/2475
(Continued)

(56) References Cited

U.S. PATENT DOCUMENTS

| | | | |
|---|---|---|---|
| 3,808,582 | A | 4/1974 | Aldridge et al. |
| 4,743,208 | A | 5/1988 | Weisenburger |
| 5,076,801 | A | 12/1991 | Schroll |
| 5,601,447 | A | 2/1997 | Reed et al. |
| 5,716,242 | A | 2/1998 | Myer |

(Continued)

FOREIGN PATENT DOCUMENTS

| | | |
|---|---|---|
| DE | 696 05 921 T2 | 6/2000 |
| DE | 201 08 985 U1 | 9/2001 |

(Continued)

OTHER PUBLICATIONS

International Search Report of PCT/DE2015/100523, dated Apr. 1, 2016.

(Continued)

*Primary Examiner* — Phuong Dinh
(74) *Attorney, Agent, or Firm* — Collard & Roe, P.C.

(57) ABSTRACT

Plug connector (10) with at least one spring or blade contact element (410) arranged in a housing, the spring or blade contact element being connected in an electrically conductive manner to at least one displacement insulation contact (430), which contacts and fixes at least one single-core, insulated cable (301, 302, 303, 304), characterized in that the at least one displacement insulation contact (430) is arranged offset by 90° in the plug direction (R) of the spring or blade contact element (410) relative to the spring or blade contact element (410) such that the at least one single-core, insulated cable is contacted and fixed in the plug direction passing through a displacement insulation contact.

6 Claims, 4 Drawing Sheets

(51) Int. Cl.

| | |
|---|---|
| ***H01R 13/11*** | (2006.01) |
| ***H01R 13/506*** | (2006.01) |
| ***H01R 13/58*** | (2006.01) |
| *H01R 107/00* | (2006.01) |

(58) Field of Classification Search
USPC ..... 439/417, 404, 409
See application file for complete search history.

(56) References Cited

U.S. PATENT DOCUMENTS

| | | | | |
|---|---|---|---|---|
| 6,270,372 | B1 * | 8/2001 | Jenner | H01R 4/2429 439/405 |
| 6,475,010 | B1 | 11/2002 | Yu | |
| 7,503,797 | B2 | 3/2009 | Lappoehn | |
| 2006/0199423 | A1 | 9/2006 | Yamanashi et al. | |

FOREIGN PATENT DOCUMENTS

| | | | |
|---|---|---|---|
| DE | 10 2006 045 808 | A1 | 4/2008 |
| DE | 20 2012 006 976 | U1 | 9/2012 |
| DE | 20 2014 105 752 | U1 | 12/2014 |
| EP | 2 290 749 | A1 | 3/2011 |
| EP | 2 747 208 | A1 | 6/2014 |
| JP | 2000-323196 | A | 11/2000 |
| WO | 87/01870 | A1 | 3/1987 |

OTHER PUBLICATIONS

German Office Action in DE 10 2014 118 687.7 dated Nov. 10, 2015 with English translation of relevant parts.

* cited by examiner

PLUG CONNECTOR HAVING AT LEAST ONE DISPLACEMENT INSULATION CONTACT OFFSET RELATIVE TO A SPRING OR BLADE CONTACT ELEMENT

CROSS REFERENCE TO RELATED APPLICATIONS

This application is the National Stage of PCT/DE2015/100523 filed on Dec. 8, 2015, which claims priority under 35 U.S.C. § 119 of German Application No. 10 2014 118 687.7 filed on Dec. 15, 2014, the disclosure of which is incorporated by reference. The international application under PCT article 21(2) was not published in English.

BACKGROUND OF THE INVENTION

Field of the Invention

The invention relates to a plug connector with at least one spring or blade contact element arranged in a housing according to the type of claim 1.

PRIOR ART

In particular in the field of automotive technology, plug connectors are known, which are provided for a number of single-core, insulated cables. All cables are, in this regard, separate within the plug connector, for example fixed and contacted with insulation displacement contacts.

Such a plug connector emerges, for example from DE 20 2012 006 976 U1. In the case of this plug connector, the spring or blade contact elements are arranged at a right angle to the single-core, insulated cables. Such a right-angled arrangement of the plug contacts relative to the single-core, insulated cable is common.

A plug connector with strain relief emerges from DE 10 2006 045 808 A1, in the case of which the plug contacts are also arranged at an angle of around 90° and which serves for contacting a number of single-core, insulated cables, which are connected to each other as flat ribbon cables. In the case of this plug connector, clamping elements are provided in the housing, which clamp cable insulation by deforming the insulation and even partially penetrating into the insulation. These clamping elements are formed as inelastic clamping elements on the plastic housing.

Contacts for a plurality of single-core, insulated cables also emerge from U.S. Pat. No. 3,808,582 and from U.S. Pat. No. 5,076,801. The contact takes place, in this regard, in a partially cumbersome manner. These contact solutions are also not readily usable in plug connectors.

SUMMARY OF THE INVENTION

The object underlying the invention is to refine a plug connector of the type described in the introduction such that a simple and secure contact of single-core, insulated cables, in particular also of a plurality of single-core, insulated cables is possible, wherein the cables should be arranged in the plug connector such that they run in the plug direction, thus not at an angle to the plug direction.

The object is achieved by the features indicated in the independent claim.

DISCLOSURE OF THE INVENTION

Advantages of the Invention

The plug connector according to the invention with at least one spring or blade contact element arranged in a housing, which is connected in an electrically conductive manner to at least one displacement insulation contact which contacts and fixes at least one single-core, insulated cable, has at least one displacement insulation contact arranged rotated by 90° in the plug direction of the spring or blade contact element relative to the spring or blade contact element, which enables it to contact and fix the at least one single-core, insulated cable passing in the plug direction through a displacement insulation contact. The basic idea of the invention is, in the case of such a plug connector, to rotate the at least one displacement insulation contact by 90° and arrange it in a line with the spring or blade contact elements such that a certain "linear" arrangement of the spring or blade contact elements and of the single-core, insulated cable is achieved. The arrangement additionally allows a simple assembly also of a plurality of single-core, insulated cables in a plug connector, as will be explained further below.

Advantageous configurations of the plug connector are subject matter of the dependent claims. It is thus, for example provided that on the side facing away from the spring or blade contact element a support is arranged integrally connected to said spring or blade contact element, on said support at least one displacement insulation contact being formed rotated by 90°. This integral design of the spring or blade contact element and of the displacement insulation contact simplifies not only the manufacture, but they are also advantageous with respect to electrical conductivity.

A particularly advantageous configuration makes provision for a clamping element to be formed on the support on the side of at least one displacement insulation contact facing away from the at least one spring or blade contact element, said clamping element, in the contacted or fixed state of the at least one single-core, insulated cable, clamping the insulation thereof to form a strain relief. The clamping element is thus part of the electrically conductive spring or blade contact element and of the displacement insulation contact and is also arranged on the support. In this way, clamping elements arranged in the housing can be dispensed with. In fact, the clamping element is manufactured together with the spring or blade contact, the displacement insulation contact and the support.

In this regard, an advantageous configuration makes provision for the spring or blade contact element, the support, the displacement insulation contact arranged on the support and the clamping element arranged on the support to form a single punched part. The spring or blade contact element, the support, the displacement insulation contact arranged on the support and the clamping element formed on the support are preferably manufactured in a punching step. Subsequently, a rotation of the displacement insulation contact by 90° takes place. Such a manufacturing method can be carried out in large numbers in an automated manner.

A very advantageous embodiment of the plug connector makes provision for the housing to have two housing parts, which are slidable into each other and are lockable to each other by simultaneous contacting of the at least one single-core, insulated cable. In this way, the contacting and fixing of the single-core, insulated cable takes place simultaneously to the assembly of the two housing parts to each other.

In this regard, it is advantageously provided that the at least one spring or blade contact element together with the at least one displacement insulation contact rotated by 90° and the at least one clamping element following said displacement insulation contact are arranged in the first housing part and that the at least one single-core, insulated cable to be contacted and fixed is arranged in a cable duct in the second housing part such that it lies on the at least one displacement insulation contact prior to the two housing parts sliding into each other.

The two housing parts preferably have lock connection elements adapted to each other, in particular locking hooks. This enables very quick and also automatic assembly by simply clipping the two housing parts into each other by simultaneous contacting and fixing of the at least one single-core, insulated cable.

The plug connector is particularly advantageous for the contacting and fixing of a plurality of single-core, insulated cables arranged lying adjacent to each other in the housing. To this end, it is provided that a plurality of spring or blade contact elements arranged in the housing are arranged lying adjacent to each other with the displacement insulation contacts and clamping elements assigned thereto.

BRIEF DESCRIPTION OF THE DRAWINGS

Exemplary embodiments of the invention are depicted in the drawings and are explained further in the description below. They show.

DESCRIPTION OF THE EXEMPLARY EMBODIMENTS

Figure 1:
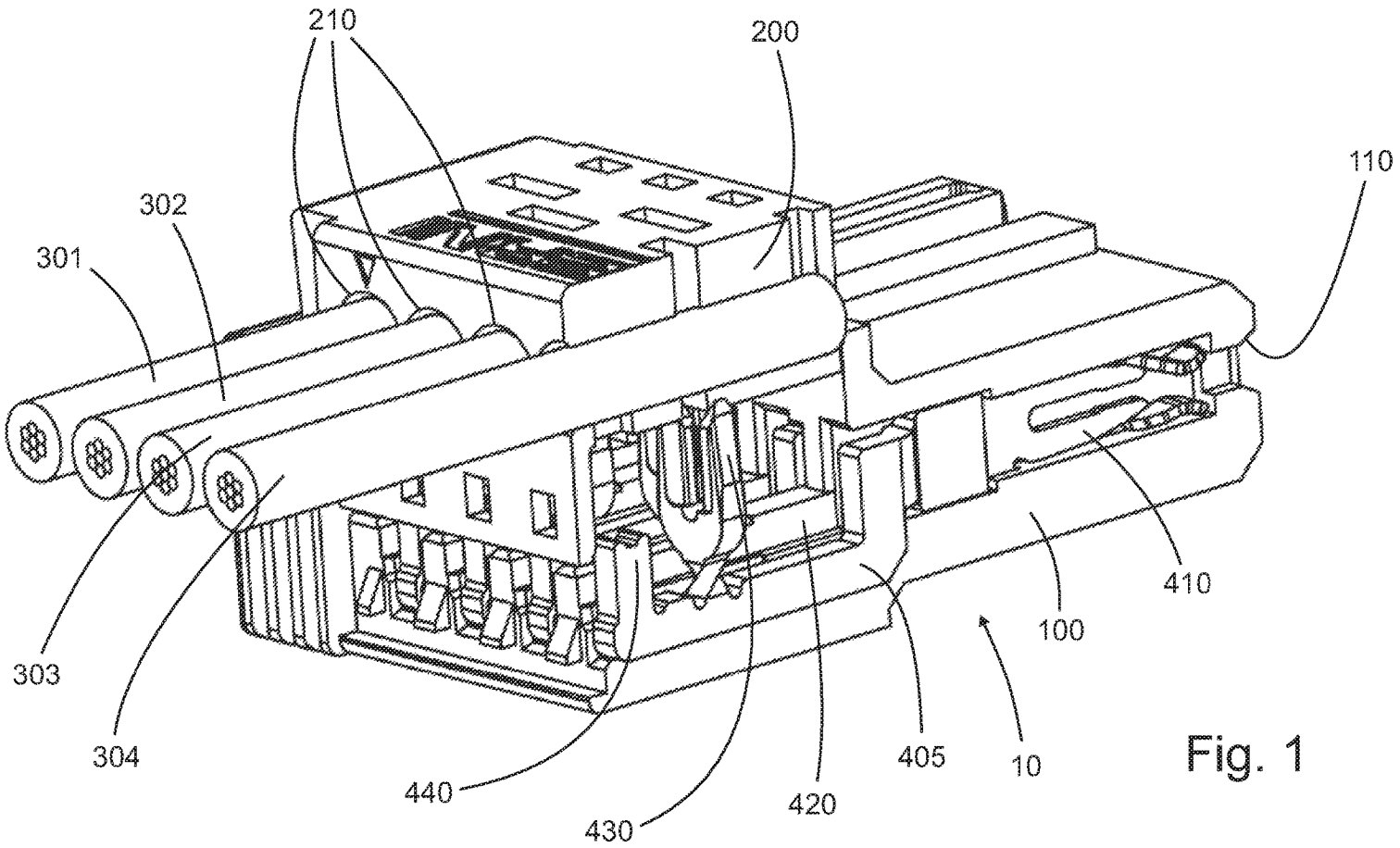
FIG. 1 an isometric depiction of a plug connector according to the invention for the contacting of a plurality of single-core, insulated cables arranged lying adjacent to each other prior to the assembly of the two housing parts to each other.

A plug connector designated as a whole with 10 has a housing, which substantially consists of two parts, a first part 100 and a second part 200, which are lockable to each other. In this first part 100, spring contact elements 410 are arranged. In the housing 100, openings 110 are provided, through which can be passed blade contact elements (not shown), adapted to the spring contact elements 410 in a manner known per se, in order to form an electrically conductive connection of the contact elements.

Figure 3:
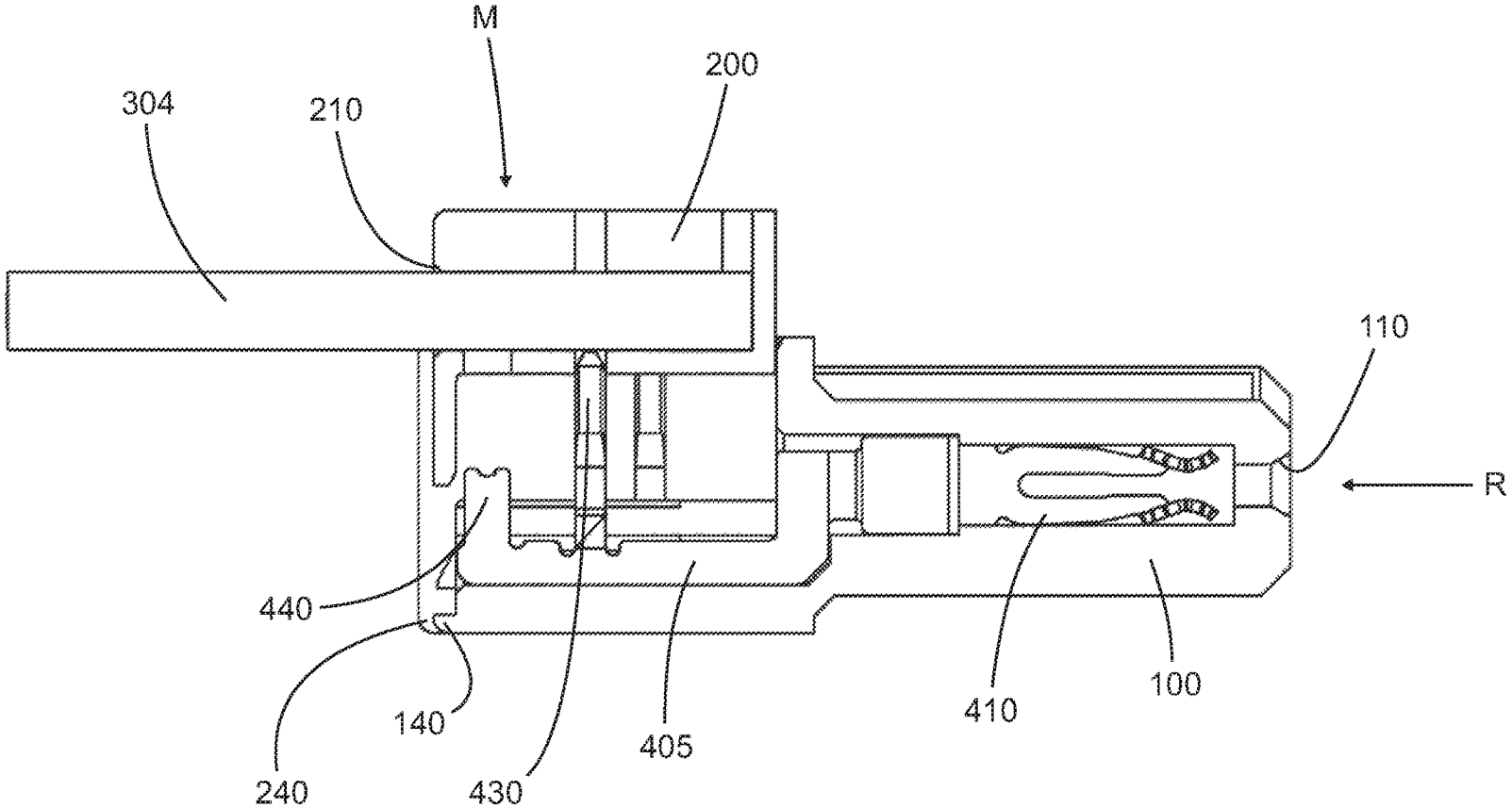
FIG. 3 a sectional depiction of the plug connector depicted in FIG. 1 and FIG. 2 prior to the assembly of the two housing parts to each other and FIG. 4 a sectional depiction of the plug connector depicted in FIG. 1 and FIG. 2 after the assembly of the two housing parts to each other.

A support 405 is integrally connected to the spring contact elements 410 (see also FIG. 3). A displacement insulation contact 430 is formed on the support 405, said displacement insulation contact being arranged perpendicular to a plug direction R (FIG. 3) in order to contact and to fix a single-core, insulated cable 304. A clamping element 440 is also integrally connected to the support 405, said clamping element being arranged in the plug direction R seen from the side of the displacement insulation contact 430 facing away from the spring contact element 410. At least one opening 210 is provided in the second housing 200, said opening being adapted to the single-core, insulated cable 304 and serves to accommodate the single-core, insulated cable 304. The single-core, insulated cable 304 is, in this regard, arranged in the second housing part 200 such that it lies on the displacement insulation contacts 430 prior to the assembly of the second housing part 200 to the first housing part 100. This state prior to the assembly is depicted in FIGS. 1 and 3.

The assembly takes place such that the second housing part 200 is slid in a direction designated with M (see FIG. 3, FIG. 4) in the direction of the first housing part 100, wherein the displacement insulation contact 430 contacts and fixes the single-core, insulated cable 304 in a manner known per se. To this end, the displacement insulation contact 430 cuts through the insulation shell of the single-core, insulated cable 304, partially also the core thereof, wherein it penetrates into the strands of the single-core, insulated cable and thus an electrically conductive connection is formed.

Figure 2:
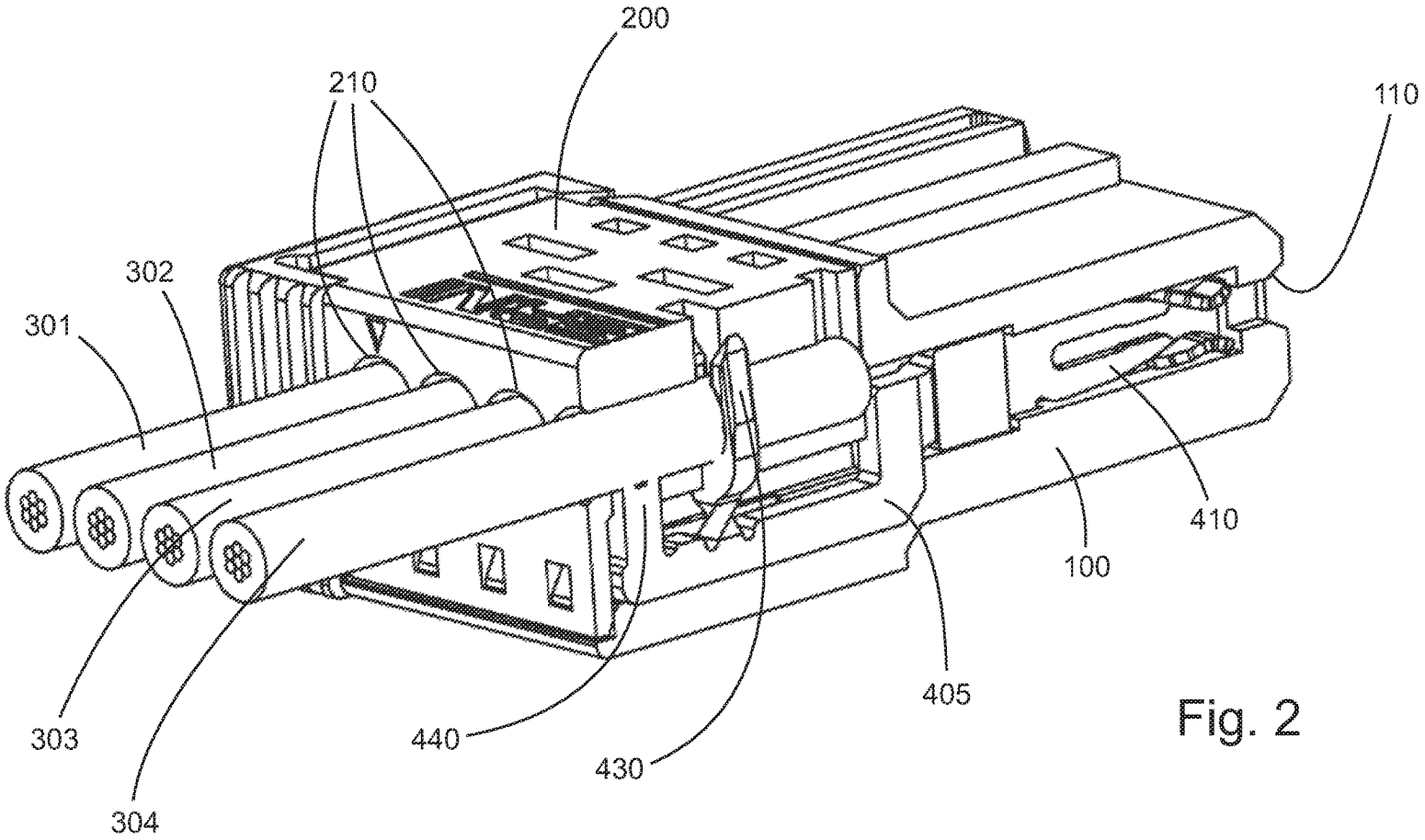
FIG. 2 an isometric depiction of the plug connector depicted in FIG. 1 after the assembly of the two housing parts to each other.
Figure 4:
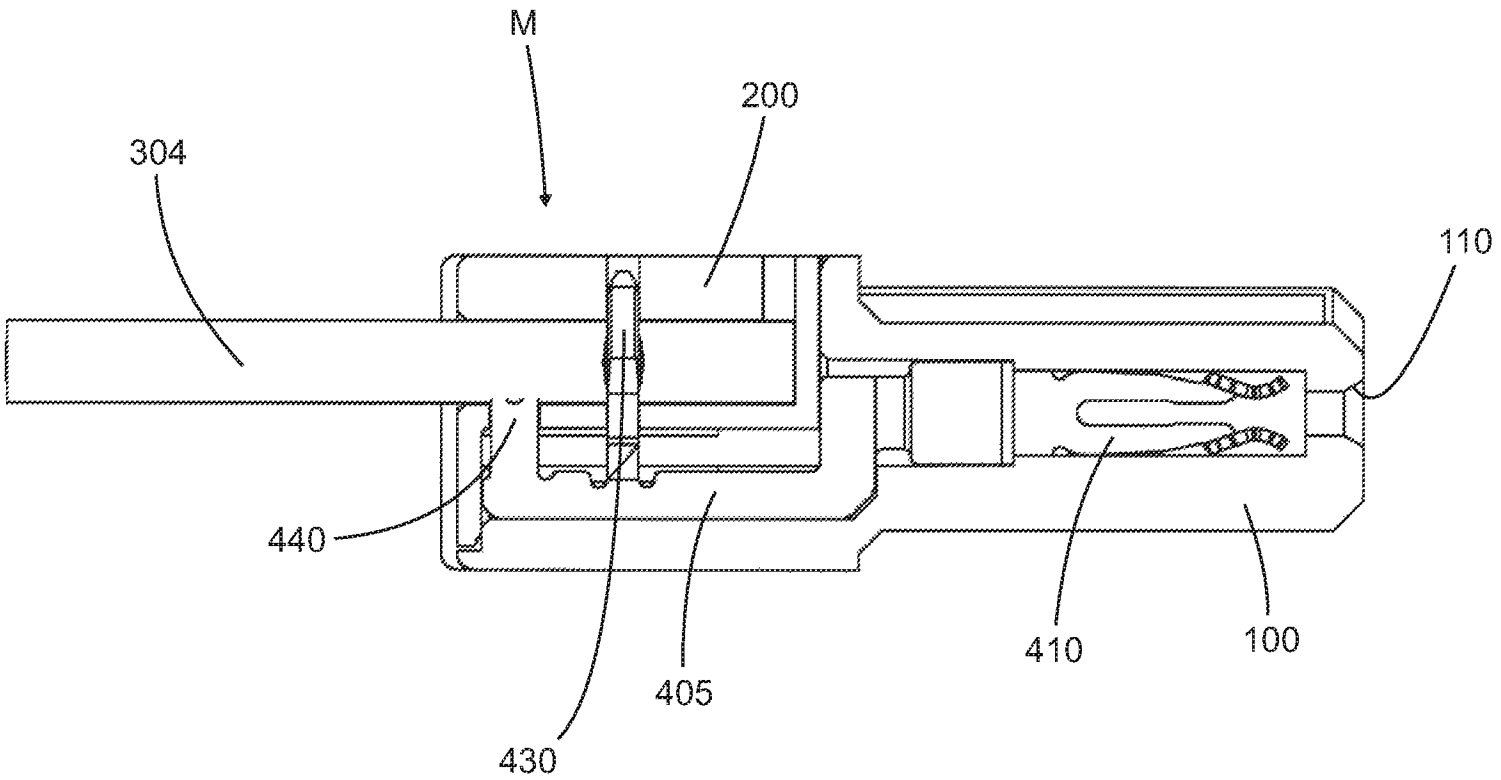

By sliding the two housing parts 200, 100 into each other, the cable 304 is also pushed onto the clamping element 440 and the clamping element 440 clamps the insulation shell of the cable 304. The clamping element 440 thus serves not only for the fixing of the cable 304, but also for strain relief. This state after the assembly is depicted in FIGS. 2 and 4.

The two housing parts have locking hooks 140, 240 adapted to each other, which lock into each other and thus hold the second housing part 200 on the first housing part 100.

The advantage of this assembly is that it is possible in a simple and also automated manner. The plug connector enables the assembly of a plurality of single-core, insulated cables 301, 302, 303, 304 lying adjacent to each other in the manner previously described, wherein these cables are arranged in the plug direction R, thus have a collinear arrangement to the spring contact elements 410. The single-core, insulated cables 301, 302, 303, 304, to a certain extent, align with the displacement insulation contacts 410.

It is understood that instead of the displacement insulation contacts 410, blade contacts (not shown) can also be provided. It is also, purely in principle, possible to form, not only one displacement insulation contact 430, but a plurality of displacement insulation contacts lying one after another on the support 405. More than one clamping element 440 can also be formed on the support.

A particular advantage consists in that the spring contact element 410, the support 405, the displacement insulation contact 430 and the clamping element 440 can be manufactured from one single punched part, preferably with a single punching process. After the punching process, only the displacement insulation contact 430 has to be rotated by 90°. Such a manufacturing process is also possible in an automated manner. A great advantage also consists in that the clamping element 440 is formed as a metal part, which is integrally connected to the spring contact element 410, the displacement insulation contact 430 via the support 405. This substantially increases the tensile strength of the single-core, insulated cable(s) in the plug connector housing. The cable is, in this case, no longer held by a clamping element arranged on the housing, but rather by a clamping element, which is connected to the spring contact element 410. In this way, clamping elements in the housing can be dispensed with, which also substantially simplifies the manufacture of the housing, while simultaneously increasing the stability.

The invention claimed is:

1. A plug connector with at least one spring or blade contact element arranged in a housing, said spring or blade contact element being connected in an electrically conductive manner to at least one displacement insulation contact, which contacts and fixes at least one single-core, insulated cable, wherein the at least one displacement insulation contact is arranged offset by 90° in the plug direction of the spring or blade contact element relative to the spring or blade contact element such that the at least one single-core, insulated cable is contacted and fixed in the plug direction passing through a displacement insulation contact, wherein a support is arranged on the side facing away from the spring or blade contact element integrally connected with said spring or blade contact element, on said support the at least one displacement insulation contact being arranged rotated by 90°, and wherein at least one clamping element is formed on the side of the at least one displacement insulation contact facing away from the at least one spring or blade contact element on the support, said clamping element, in the contacted and fixed state of the at least one single-core, insulated cable, clamping the insulation in order to form a strain relief.

2. The plug connector according to claim 1, wherein the spring or blade contact element, the support, the at least one displacement insulation contact and the at least one clamping element form a single punched part.

3. The plug connector according to claim 1, wherein the housing has two housing parts, which are slidable into each other and are lockable to each other by simultaneous contacting and fixing of the at least one single-core, insulated cable.

4. The plug connector according to claim 3, wherein the at least one spring or blade contact element together with the at least one displacement insulation contact rotated by 90° and the at least one clamping element following said displacement insulation are arranged in the first housing part and wherein the at least one single-core, insulated cable to be contacted and to be fixed is arranged in a cable duct in the second housing part such that it lies on the at least one displacement insulation contact prior to the two housing parts sliding into each other.

5. The plug connector according to claim 3, wherein the two housing parts have lock connection elements adapted to each other.

6. The plug connector according to claim 1, wherein a plurality of spring or blade contact elements arranged in the housing, each having an associated displacement insulation contact and clamping element, are arranged side by side.

* * * * *